United States Patent [19]

Pejchal et al.

[11] 4,165,049

[45] Aug. 21, 1979

[54] THREAD STORAGE AND DELIVERY APPARATUS

[75] Inventors: Karel Pejchal, Ulricehamn; Lars H. G. Tholander, Huskvarna, both of Sweden

[73] Assignee: AB IRO, Ulricehamn, Sweden

[21] Appl. No.: 870,017

[22] Filed: Jan. 16, 1978

[30] Foreign Application Priority Data

Jan. 17, 1977 [DE] Fed. Rep. of Germany ..... 2701718
Jun. 3, 1977 [DE] Fed. Rep. of Germany ..... 2725185

[51] Int. Cl.[2] ..... B65H 51/20
[52] U.S. Cl. ..... 242/47.01; 139/452
[58] Field of Search ..... 242/47.01, 47.12, 47.13, 242/82, 83, 47; 139/452; 66/132 R

[56] References Cited

U.S. PATENT DOCUMENTS

| | | | |
|---|---|---|---|
| 3,411,548 | 11/1968 | Pfarrwaller | 242/47.12 X |
| 3,720,384 | 3/1973 | Rosen | 242/47.01 |
| 3,737,112 | 6/1973 | Tellerman et al. | 242/47.01 |
| 3,759,300 | 9/1973 | Pfarrwaller | 242/47.01 X |
| 3,761,031 | 9/1973 | Pfarrwaller | 242/47.01 |
| 3,776,480 | 12/1973 | Lawson | 242/47.01 |
| 3,791,598 | 2/1974 | Vischiani et al. | 242/47.12 |
| 3,834,635 | 9/1974 | Pfarrwaller | 242/47.01 |
| 3,944,156 | 3/1976 | Jacobsson et al. | 242/47.12 |
| 3,971,522 | 7/1976 | Pfarrwaller | 242/47.01 |

*Primary Examiner*—Stanley N. Gilreath
*Attorney, Agent, or Firm*—James E. Nilles

[57] ABSTRACT

A rotatable shaft carries a winding instrumentality whereby thread to be temporarily stored is coiled around a thread drum rotatably mounted on the shaft. Rotation of the thread drum in the direction of shaft rotation is prevented by concentric relatively fixed and movable brake elements, the fixed one secured to housing for the apparatus, the movable one coaxially secured to the thread drum. One of the brake elements has a circumferential surface from which elongated resilient fingers project, the fingers being more or less radial to said surface and having their tips normally engaged under flexing bias against a circumferential braking surface on the other brake element. The thread passes through the zone of the fingers, and the several fingers are so inclined to radials from the common center of the brake elements that the thread, or a guide tube through which it extends, can flexingly cam each finger, in turn, out of engagement with the braking surface and pass around the finger.

10 Claims, 7 Drawing Figures

VII
VII
5'a
5'b
11
5'a
5"a
F
24
11
6
5"a
7
3
8
F'
16
7
15
11
5a
10
9
18
17
6
11
112
5
3a
1
2
2
23
4

THREAD STORAGE AND DELIVERY APPARATUS

This invention relates to apparatus for temporarily storing a supply of thread that is being drawn from a supply spool or other source and is being delivered to a loom or similar point of use, of the type wherein a winding instrumentality carried by a rotating shaft coils thread onto a thread drum that is rotatably mounted on the shaft; and the invention is more particularly concerned with improved means in such apparatus for preventing undesired rotation of the thread drum.

In a known arrangement in apparatus of the type with which this invention is concerned, the thread drum, which has a horizontal axis, is unbalanced by means of a substantial eccentric mass, and it is thus restrained against rotating with the shaft on which it is mounted and which drives the thread winding instrumentality. This unbalancing expedient is expensive to manufacture, increases the weight of the total assembly, and provides no assurance that rotation of the thread drum will be completely prevented.

In another known arrangement, the thread drum is magnetically confined against rotation with the shaft on which it is mounted. A ring surrounding an end portion of the thread drum carries a pair of permanent magnets which cooperate with keepers set into the interior of the thread drum. This arrangement is both heavier and more expensive than the one comprising an eccentric weight.

The general object of the present invention, by contrast with these known expedients, is to provide a very simple, inexpensive and light weight device for a thread storage and delivery apparatus of the character described, which device assures against rotation of the thread drum with rotation of the shaft upon which it is rotatably mounted and which also carries the winding instrumentality.

Another and more specific object of the invention is to provide means for preventing undesired rotation of the thread drum in a thread storage and delivery apparatus, whereby a constant and effective braking force is applied to the thread drum and whereby, at the same time, a substantially constant tensioning force can be imposed upon the thread in one embodiment of the invention.

Another specific object of the invention, achieved in another embodiment, is to provide a braking device whereby undesired rotation of the thread drum is prevented and whereby no tension is imposed upon the thread, so that the thread tension can be completely controlled by other means.

It is a further specific object of the invention to provide a braking device of the character described that can be readily so arranged that both the relatively fixed and the relatively movable brake elements of the device can be quickly and easily removed and replaced, either for purposes of repair or for purposes of changing the operating characteristics of the device.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings of several complete examples of the embodiments of the invention constructed according to the best modes so far devised for the practical application of the principles thereof, and in which.

Figure 1:
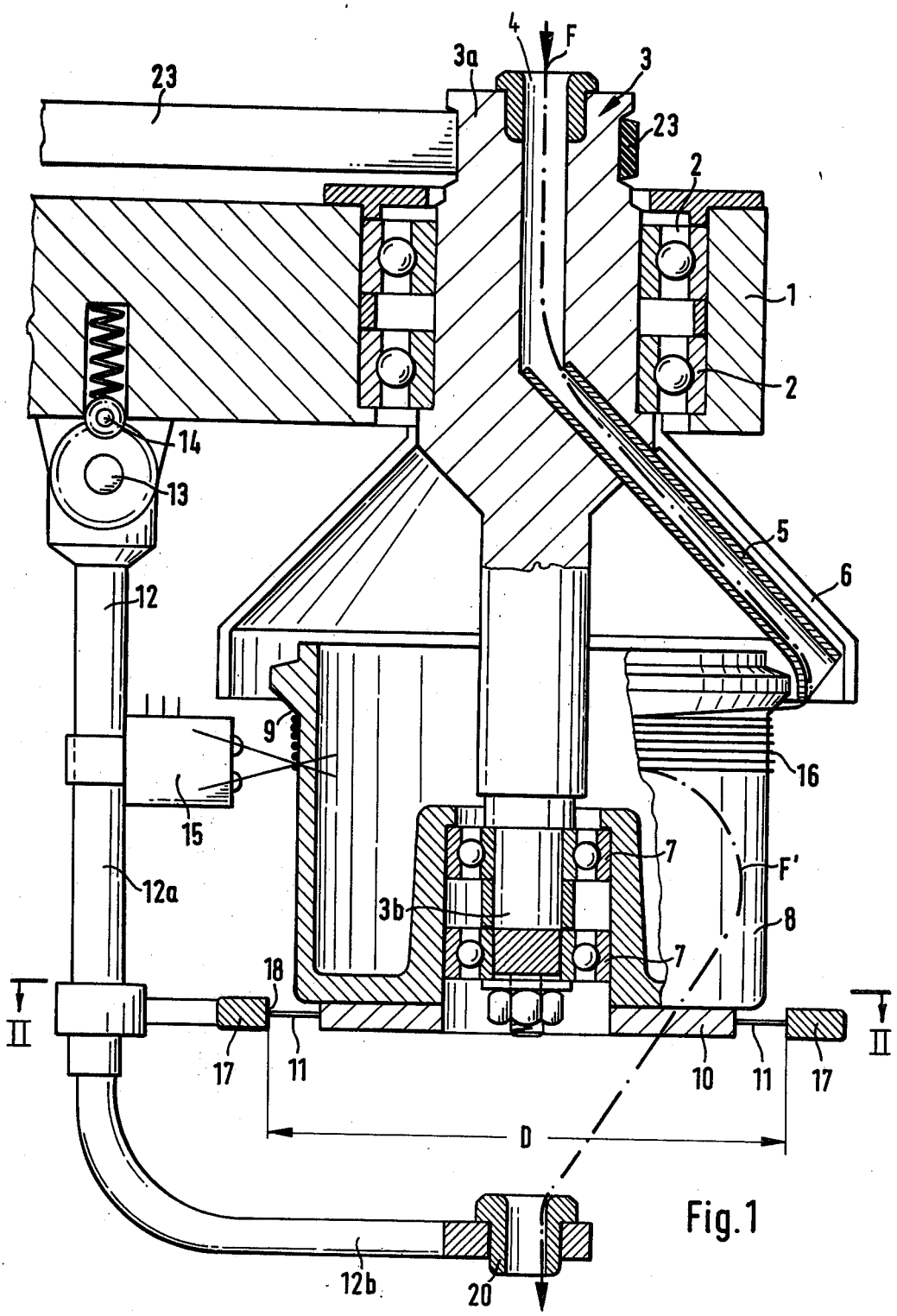
FIG. 1 is a view in longitudinal section of a thread storage and delivery device embodying the principles of the invention.

Referring now to the accompanying drawings, and first giving attention to the thread storage and delivery arrangement illustrated in FIG. 1, the apparatus comprises a housing 1, of which only a small portion is shown and which supports roller bearings 2 wherein a shaft 3 is journaled. Normally the apparatus is so arranged in use that the shaft 3 has its axis horizontal. The shaft 3 has several reductions in diameter along its length, its largest diameter portion 3*a* being supported by the housing 1.

The shaft 3 has one end portion which is relatively near the housing 1 and has an opposite end portion which is spaced a substantial distance from the housing and on which a thread drum 8 is rotatably mounted. However, as explained hereinafter, the thread drum is prevented from rotating with the shaft 3, and therefore a winding instrumentality which rotates with the shaft 3 and which is described below can coil thread around the thread drum.

To provide for rotatably driving the shaft 3, it can have a pulley-like groove in its end portion that is nearer the housing 1, and an endless belt 23 can be received in that groove and driven by an electric motor (not shown) or the like.

Thread is drawn towards the thread drum 8 through a thread channel 4 that opens coaxially to the end of the shaft 3 at which the belt 23 is located. At its axially inner end the thread channel 4 communicates with a thread guide tube 5 that extends obliquely radially outwardly from the shaft axis and axially in the direction away from the adjacent end of the shaft. The thread guide tube 5, which projects outside the body of the shaft 3, is secured to a conical winding instrumentality 6 that is coaxially mounted on the shaft. It will be understood that both the thread guide tube 5 and the winding instrumentality 6 are constrained to rotate with the shaft 3.

The end portion 3*b* of the shaft 3 that is more distant from the housing 1 supports bearings 7 upon which the thread drum 8 is carried for rotation independently of the shaft. The end portion of the thread drum 8 that is nearer the housing 1 is overlapped by the winding instrumentality 6 and has an axially inwardly tapering frustoconical surface 9 by which a thread being wound onto the drum is guided onto the main cylindrical surface portion thereof.

The thread drum 8 is normally prevented from rotating relative to the housing 1 in the direction that the shaft 3 rotates, but it is permitted to rotate in the opposite direction. As shown in FIG. 1, the means for so controlling rotation of the thread drum 8 comprises a relatively movable annular brake element 10 that is constrained to rotate concentrically with the thread drum and a cooperating relatively fixed annular brake element 17 having a coaxial radially inner braking surface 18.

Figure 3:
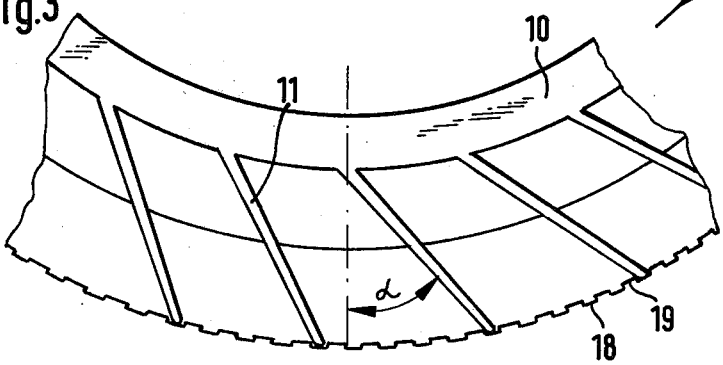
FIG. 3 is a fragmentary view of a portion of the apparatus seen in FIG. 2, but on a much enlarged scale.

As shown in FIG. 1, the relatively movable brake element 10 is coaxially secured to the end of the thread drum that is remote from the housing 1. Its connection to the drum is preferably a readily detachable one. As best seen in FIG. 3, relatively thin elastic fingers 11, each having substantially uniform thickness and stiffness along its length, project from the periphery of the relatively movable brake element 10, all around the same, to engage under resilient bias against the braking surface 18 on the relatively fixed annular brake element 17. The fingers 11 project obliquely, radially outwardly and in the direction of shaft rotation, so that they are inclined at angles $\alpha$ to radials from the center of the annular brake element 10.

The braking surface 18 on the annular relatively fixed brake element 17 has a diameter such as to maintain the fingers 11 on the relatively movable brake element under some flexure. Furthermore, the braking surface is formed with grooves or wells 19 that provide abutments against which the tips of the fingers 11 engage to prevent the relatively movable brake element 10 from rotating with the shaft 3.

Figure 2:
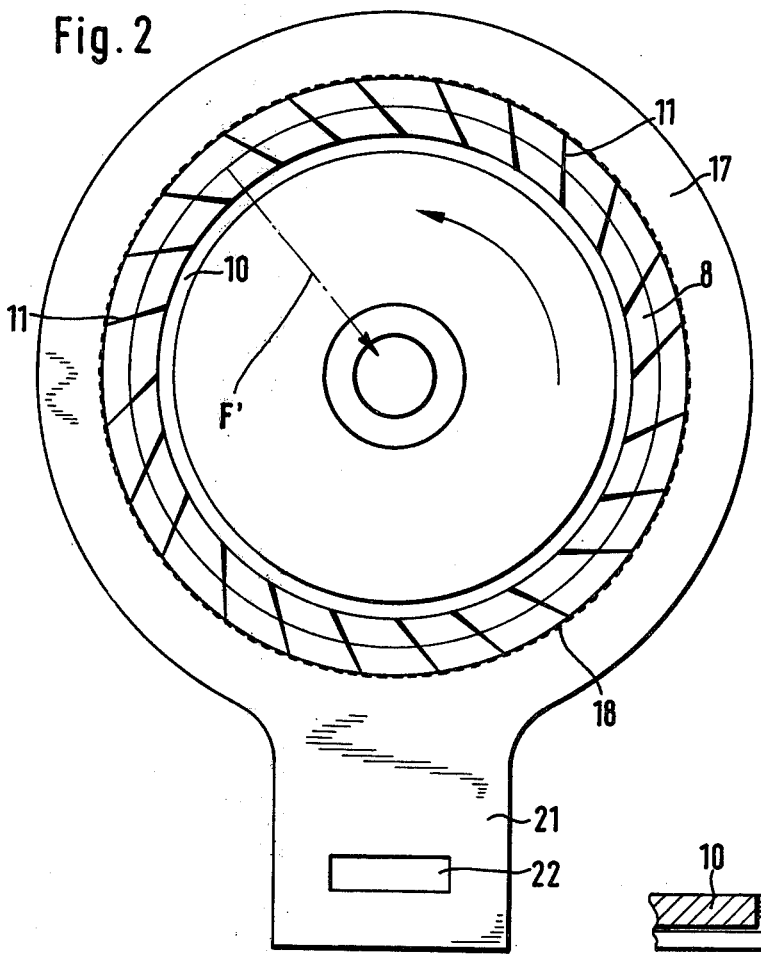
FIG. 2 is a schematic end view of the apparatus shown in FIG. 1, such as would be seen in the plane of the line II—II in FIG. 1.

The relatively fixed annular brake element 17 is supported upon a more or less L-shaped bracket 12 that has one of its ends connected to the housing 1 by means of a pivot pin 13. The bracket is swingable about the pin 13 to and from an operative position in which it is shown in FIG. 1 and in which it is held by a spring-biased detent ball 14. When the bracket 12 is in its operative position, one of its arms **12*a* extends parallel to the shaft 3, terminating beyond the outer end of the thread drum. Between its ends, that arm 12*a* supports an optical control instrumentality 15 (illustrated only schematically) for detecting the thread supply 16 that has been wound onto the thread drum. At its end remote from the pivot pin 13, the arm 12*a* carries the relatively fixed annular brake element 17, normally supporting it in substantially coplanar surrounding relation to the movable brake element 10. The fixed brake element can have an integral lug or projection 21 (see FIG. 2) in which there is a recess 22 wherein the bracket arm 12*a*** is received.

The other arm **12*b* of the bracket 12 terminates in a thread withdrawal eye 20 which is spaced a small distance beyond the drum 8 and is concentric with the shaft 3. Thread F' that is being drawn off of the thread drum passes through the eye 20** to be guided thereby.

As the shaft 3 rotates, driven by the belt 23, it in turn imparts rotation to the winding instrumentality 6 and the thread guide tube 5, so that a thread F can be drawn in the direction of the arrow in FIG. 1, from a supply spool (not shown) and through the thread channel 4 and the tubular thread guide 5, to be coiled around the thread drum 8 and thus form a thread supply 16. In the arrangement shown in FIGS. 1–3, thread F' that is drawn off of the thread drum passes through the zone of the elastic fingers 11, between the annular brake elements 10 and 17, and thence through the thread withdrawal eye 20 to a point of use, which can be a loom (not shown). As thread is drawn off of the drum 8, it tends to spiral from it in the rotational direction in which the fingers 11 are inclined, sliding radially outwardly along a finger until it bears against the tip portion thereof, and then flexing the finger radially inwardly, away from the braking surface 18. The thread can thus pass around the finger, between its tip and the braking surface 18, and then advance to the circumferentially adjacent finger which, after a short time, it similarly flexes and passes around. As the thread passes each finger, the finger, in response to its own elasticity, immediately returns to engagement with the braking surface 18.

A torque that tends to rotate the drum 8 in the same direction as the shaft 3 is imposed upon the drum by the shaft, due to friction in the bearings 7, and that torque force is augmented by one that the drawn-off thread applies to the finger or fingers with which it is engaged. Since a substantially large majority of the fingers 11 remain engaged with the braking surface 18, even when thread is being drawn off of the drum 8 through the zone of the fingers, the fingers are always effective to resist rotation of the thread drum in response to the above-mentioned torque forces upon it. Such effective braking is assured by the circumferential spacing between the fingers 11, which enables each finger displaced by the drawn-off thread to spring back into engagement with the braking surface 18 before a circumferentially adjacent finger is disengaged from that surface. It will be apparent that the braking device of FIGS. 1–3 not only controls rotation of the thread drum 8 but also controls the rate at which the drawn-off thread F' is withdrawn from the thread drum.

Figure 4:
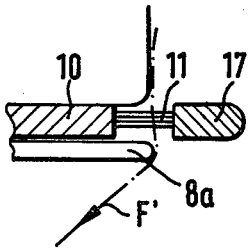
FIG. 4 is a fragmentary longitudinal sectional view illustrating a modification of the embodiment of the invention illustrated in FIGS. 1-3.

FIG. 4 illustrates a form of the invention that is modified by the provision of a deflector plate **8*a* that is axially outwardly adjacent to the relatively movable brake element 10. Th deflection plate 8*a* has a diameter approximately equal to that of the thread drum and therefore somewhat greater than that of the movable brake element 10. It prevents the withdrawn thread F' from being drawn too far towards the radially inner ends of the fingers 11**, thus assuring that the thread will come off of the storage and supply apparatus with a relatively smooth, steady motion.

The thread storage and supply apparatus depicted in FIGS. 5 to 7 corresponds in its basic arrangement to that of FIGS. 1–4, and therefore elements of the structure of FIGS. 5–7 that are like those of FIGS. 1–4, or substantially like them, are designated by corresponding reference characters, and only the differences are hereinafter described.

Figures 5, 6, 7:
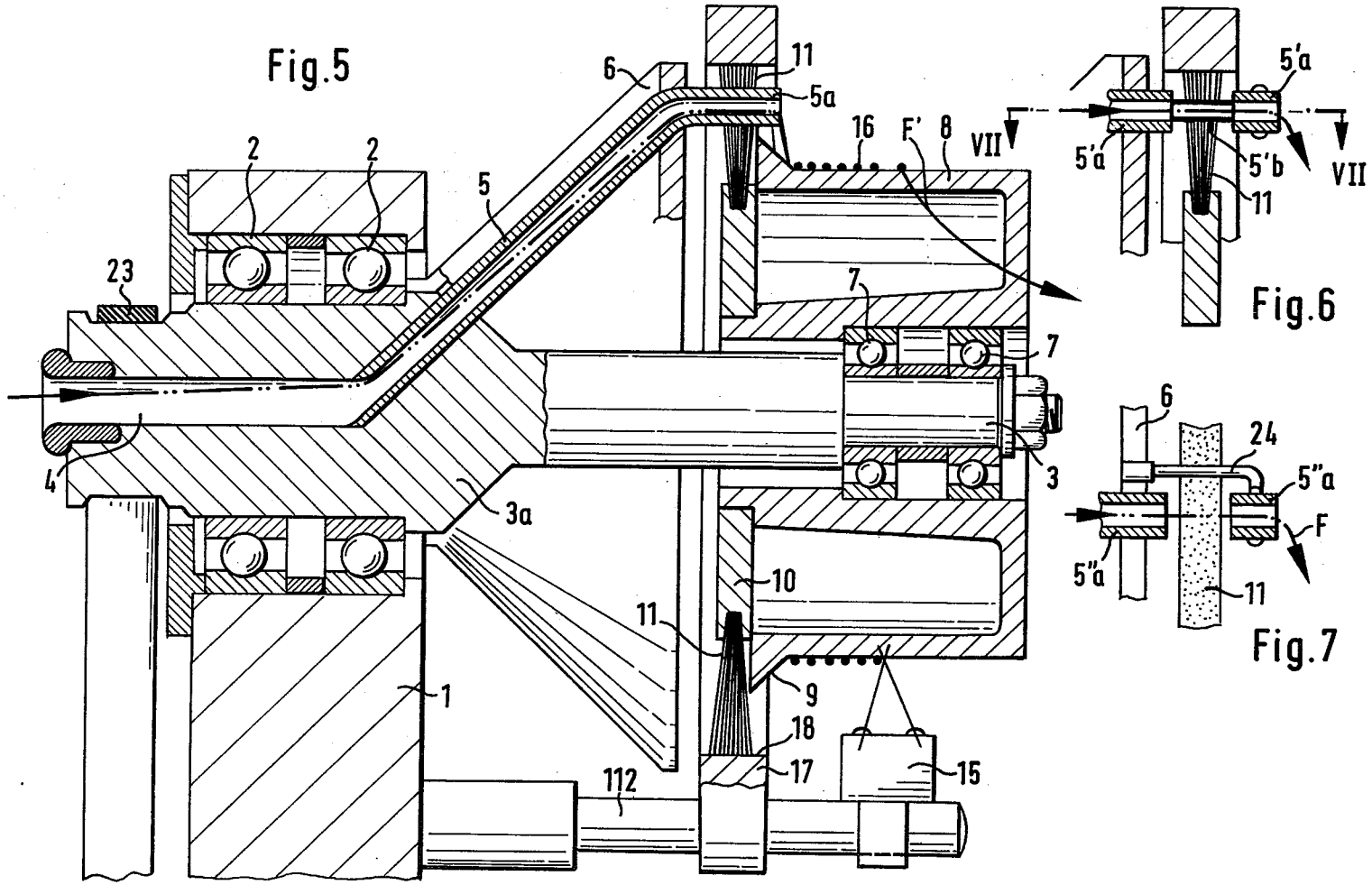
FIG. 5 is a view generally similar to FIG. 1 but illustrating a modified embodiment of the invention.
FIG. 6 is a fragmentary view in longitudinal section illustrating a further modification of the embodiment of the invention shown in FIG. 5.
FIG. 7 is a view such as would be taken in the plane of the line VII—VII in FIG. 6, but illustrating an alternative solution to the modification shown in FIG. 6.

In this case, as best seen in FIG. 5, the braking ring 10 that carries the elastic fingers 11 is secured to the thread drum 8 at the end thereof that is nearer the housing 1, and the fingers are arranged in circumferentially spaced groups, each group comprising a brush-like axially extending row of very slender fingers. The relatively fixed braking element 17 is again annular, with a suitable radially inner braking surface 18 against which the fingers 11 engage under resilient bias. A supporting arm 112 extends from the housing 1, parallel to the axis of the shaft 3, and holds the braking element 17 in fixed concentric relation to the thread drum 8 and substantially coplanar with the relatively movable annular brake element 10. By means of the fingers 11, cooperating with the braking surface 18 as above described, the thread drum 8 is confined against rotation in the direction that the shaft 3 is driven, as above described.

In this case an incoming segment of the thread extends through the zone of the elastic fingers 11. Specifically, as shown in FIG. 5, an outer end portion 5*a* of the thread guide tube 5 is disposed at such an angle to the inclined main portion of that tube as to extend parallel to the axis of the shaft 3, and the thread is carried through the zone of the elastic fingers 11 within that tube end portion 5*a*.

The arrangement illustrated in FIG. 5 has the advantage of being very compact, in that the thread drum braking device is located close to the housing 1 and the carrying arm 112 need not extend all along the drum 8 to its end remote from the housing. The arm 112 need be only long enough to support the optical device 15 that monitors the thread supply 16 on the drum. In this case, the braking device has no influence upon the tension of the thread that is being wound onto the drum, nor upon the tension of the thread being removed from the drum, and thread tension can be wholly controlled by other known means.

FIG. 6 illustrates a modified form of the outer end portion 5' of the thread guide tube. Its section 5'*b* that extends through the zone of the fingers 11 has substantially smaller inside and outside diameters than its portions at each end of that section, and is just large enough in diameter to accommodate the thread. Thus a very thin tubing section moves through the zone of the fingers 11, so that each finger is displaced only very briefly from engagement with the cooperating braking surface 18, and a lesser portion of the total number of fingers are disengaged from that surface at any given time.

In the further modified embodiment illustrated in FIG. 7, the thread guide tube is discontinuous in its portion 5''*a* that extends through the zone of the elastic fingers 11, so that the bare thread F itself engages those fingers. Portions 5''*a* of the thread guide tube at opposite sides of the discontinuity are connected by a light supporting yoke 24, so that, notwithstanding the discontinuity, the thread guide tube effectively extends to the level of the infeed surface 9 on the thread drum 8. In rotating with the winding instrumentality, the supporting yoke 24 can move in a circular orbit having a diameter approximately corresponding to that of the orbit of the exposed thread segment, and preferably it follows the thread in its circular motion, so as to act upon individual fingers 11 after the thread has passed them. Since both the thread and the carrying yoke 24 are of small cross section, only a very few of the fingers 11 are at any given time displaced from engagement with the braking surface, and therefore the maximum possible braking effect is maintained. Inasmuch as the bare thread engages the elastic fingers in this embodiment, the fingers cooperate to maintain a certain amount of tension in the thread that is being wound onto the drum 8, which tension is to some extent controlled by the proximity of the carrying yoke 24 to the exposed thread segment.

The invention is not limited to the disclosed embodiments. In particular, the brake element that carries the fingers 11 can obviously be the relatively stationary one that is fixed to the housing, while the braking surface that cooperates with the fingers could be on the relatively movable brake element that is fastened to the thread drum. In that case the fingers would be arranged to extend essentially radially from the fixed brake element towards the cooperating braking surface, assuming that the directions of rotation and of thread winding remained the same.

Means for mounting the brake elements can vary widely within the scope of the invention, as can the journaling of the shaft, the arrangements for guiding the thread, and details of the thread winding instrumentality. Furthermore, it will be evident that the braking surface that is engaged by the elastic fingers can have any sort of roughening or irregularity for providing friction or abutments by which the tips of the fingers are confined against circumferential motion in the direction in which the fingers are inclined. Thus, instead of the ridges, as shown, the braking surface could have suitable holes, wells or nubs.

From the foregoing description, taken with the accompanying drawings, it will be evident that this invention provides a thread storage and delivery arrangement having novel and improved means for preventing the thread drum from rotating with the shaft on which the thread drum is rotatably journaled and which carries the winding instrumentality.

Those skilled in the art will appreciate that the invention can be embodied in forms other than as herein disclosed for purposes of illustration.

The invention is defined by the following claims:

1. Thread storage and delivery apparatus of the type comprising a shaft that is rotatable in a housing and is driven for rotation in one direction, a thread drum concentrically mounted on a portion of said shaft for rotation relative thereto and upon which thread is wound, and thread guide means so arranged in relation to the drum that thread wound around the drum has a drawn-in stretch extending substantially axially towards the drum from one end thereof and a drawn-off stretch extending substantially axially away from the other end of the drum, said thread guide means comprising a thread guiding part of a thread winding instrumentality that is carried by another portion of said shaft and is moved orbitally by shaft rotation to cause a thread guided thereby to be coiled around the thread drum, said apparatus further comprising braking means for restraining the three drum against rotation in said direction relative to the housing, which braking means is characterized by:

A. a relatively movable brake element concentrically secured to one end of the drum;

B. a relatively fixed brake element secured to the housing;

C. one of said brake elements having a circumferential surface that is concentric to said shaft and is spaced from and substantially directly faces an annular portion of the other brake element;

D. a plurality of elongated resilient fingers secured to said other brake element at circumferentially spaced locations around said annular portion of the same, said fingers projecting towards said surface on the one brake element and being of such lengths that each has its tip engaged against said surface;

E. friction means on said surface, engageable by the tips of said fingers to hold the same against sliding along said surface in said direction of rotation; and F. said thread guide means being further so arranged that one of said stretches extends through the zone of the fingers, substantially transversely to the fingers.

2. The apparatus of claim 1, further characterized by: said fingers being so oriented that each is inclined towards said surface and in said direction of shaft rotation.

3. The apparatus fo claim 1 wherein said relatively movable brake element is secured to the drum axially adjacent to said one end thereof and wherein said thread guide means comprises a tubular thread guiding part through which said drawn-in stretch of thread extends and by which a portion of that stretch is constrained to move orbitally in the zone of the fingers and to extend transversely to them.

4. The apparatus of claim 3 wherein said tubular thread guiding part has a discontinuity therein by which said portion of said drawn-in stretch of thread is exposed to the fingers to be directly in contact with them.

5. The apparatus of claim 1 wherein said relatively movable brake element is secured to the drum axially adjacent to said other end thereof and wherein said thread guide means further comprises an eye fixed in substantially coaxial relation to the drum and axially spaced from its said other end, through which the drawn-off stretch of thread extends after passing through the zone of the fingers.

6. Thread storage and delivery apparatus of the type comprising a shaft that is rotatable in a housing and is driven for rotation in one direction, a thread drum concentrically mounted on a portion of said shaft for rotation relative thereto and upon which thread is wound, thread guide means so arranged in relation to the drum that thread wound around the drum has a drawn-in stretch extending substantially axially towards the drum from one end thereof and a drawn-off stretch extending substantially axially away form the other end of the drum, said thread guide means comprising a thread guiding part of a thread winding instrumentality that is carried by another portion of said shaft and is moved orbitally by shaft rotation to cause a thread guided thereby to be coiled around the thread drum, and braking means for restraining the thread drum against rotation in said direction relative to the housing, said braking means comprising a movable brake element secured to the thread drum and a fixed brake element secured to the housing, wherein said braking means is characterized by:

A. said movable brake element being concentrically secure to one end of the drum;

B. said fixed brake element being secured to the housing in concentric relation to said movable brake element;

C. means for preventing relative rotation in said one direction between said brake elements, comprising (1) a plurality of elongated resilient fingers on one of said brake elements, secured at circumferentially spaced intervals around a concentric annular portion thereof, and (2) a concentric circumferential surface on the other of said brake elements that is frictionally engaged by the tips of said fingers, said surface (a) being spaced from said annular portion and substantially directly facing the same and (b) having friction means thereon with which the tips of the fingers cooperate to be held against sliding along said surface in said direction of rotation; and D. said thread guide means being further so arranged that one of said stretches extends through the fingers substantially transversely to them.

7. The apparatus of claim 6, further characterized by:

E. the distance between said annular portion on the one brake element and said surface in the other brake being such that said fingers have their tips engaged against said surface under flexing bias.

8. The apparatus of claim 7, further characterized by:

F. said fingers being so oriented that each is inclined towards said surface and in the direction of shaft rotation.

9. The apparatus of claim 6 wherein said surface on the other of said brake elements faces substantially radially towards said annular portion on said one brake element, and wherein said fingers substantially lie in a plane normal to the axis of said shaft.

10. Thread storage and delivery apparatus of the type comprising a shaft that is rotatable in a housing and is driven for rotation in one direction, a thread drum concentrically mounted on a portion of said shaft for rotation relative thereto, a thread winding instrumentality carried by another portion of said shaft and which has a thread guiding part that is moved orbitally by shaft rotation and the orbital motion of which causes a thread guided thereby to be drawn from beyond one end of the thread drum and coiled around said drum, a pair of concentric members, one of which is fixed to the drum at the other end thereof and the other of which is fixed to the housing, and a plurality of resiliently flexible fingers disposed in a ring, all fixed to an annular portion of one of said concentric members and projecting towards the other, said fingers being disposed in the path of a stretch of thread being drawn off of the thread drum to a location beyond said other end thereof, which stretch of thread extends transversely to said fingers and is maintained under tension by flexing displacement of the fingers, said apparatus being characterized by:

A. said other concentric member having an annular frictional surface which is concentric to said annular portion of said one concentric member and directly faces the same;

B. said fingers having their tips engaged against said frictional surface under resiliently flexing bias; and C. said fingers being so oriented that they extend towards said frictional surface with an inclination in said direction of rotation, so that by the engagement of the tips of the fingers against said frictional surface the thread drum is braked against rotation in said direction.

* * * * *